US011506376B2

(12) United States Patent
Mazeaud et al.

(10) Patent No.: US 11,506,376 B2
(45) Date of Patent: Nov. 22, 2022

(54) INDUSTRIAL LIGHTING DEVICE

(71) Applicant: TPL VISION UK LTD, Charing (GB)

(72) Inventors: Guillaume Mazeaud, Glencarse (GB); Jack McKinley, Edinburgh (GB)

(73) Assignee: TPL VISION UK LTD, Charing (GB)

( * ) Notice: Subject to any disclaimer, the term of this patent is extended or adjusted under 35 U.S.C. 154(b) by 0 days.

(21) Appl. No.: 17/362,577

(22) Filed: Jun. 29, 2021

(65) Prior Publication Data

US 2022/0003402 A1 Jan. 6, 2022

(30) Foreign Application Priority Data

Jul. 2, 2020 (FR) ..... 2007025

(51) Int. Cl.

| | |
|---|---|
| ***F21V 31/00*** | (2006.01) |
| ***F21S 4/28*** | (2016.01) |
| ***F21V 14/08*** | (2006.01) |
| ***F21V 15/01*** | (2006.01) |

(Continued)

(52) U.S. Cl.

CPC ..... *F21V 31/005* (2013.01); *F21S 4/28* (2016.01); *F21V 14/08* (2013.01); *F21V 15/01* (2013.01); *F21W 2131/40* (2013.01); *F21Y 2115/10* (2016.08)

(58) Field of Classification Search

CPC ..... F21V 31/005; F21V 14/08; F21V 15/01; F21V 9/00; F21V 31/00; F21S 4/28; F21W 2131/40; F21W 2131/402; F21W 2131/403; F21Y 2115/10

See application file for complete search history.

(56) References Cited

U.S. PATENT DOCUMENTS 4,039,820 A * 8/1977 Materese ..... F21V 31/00 362/223
8,714,771 B2 * 5/2014 Nishimori ..... F21V 17/10 362/225

(Continued)

FOREIGN PATENT DOCUMENTS

FR 2050867 A5 4/1971

OTHER PUBLICATIONS

European Office Action, from Corresponding European Application No. 21183404.9, dated Nov. 17, 2021.

(Continued)

*Primary Examiner* — Tsion Tumebo

(74) *Attorney, Agent, or Firm* — Ronald M. Kachmarik; Cooper Legal Group LLC

(57) ABSTRACT

Industrial lighting device including a light source and a sealed housing containing the light source. The housing includes a support delimiting a housing window extending opposite the light source, a window pane sealing the housing window, and a sealing gasket extending along the periphery of the housing window and compressed between the window pane and the support. The device includes a filter extending in front of the housing window, outside the housing. The filter includes a frame defining a frame window which is removably fixed to the housing, in an assembled position in which the frame window is opposite the housing window, and an optical film fixed to the frame and sealing the frame window. The device includes an elastic compression member arranged between the support and the frame.

14 Claims, 5 Drawing Sheets

(51) Int. Cl.
*F21Y 115/10* (2016.01)
*F21W 131/40* (2006.01)

(56) References Cited

U.S. PATENT DOCUMENTS

| | | | | |
|---|---|---|---|---|
| 8,931,928 | B2 * | 1/2015 | Heintz | F21V 21/14 362/249.02 |
| 9,845,928 | B1 * | 12/2017 | Tyson | F21V 29/83 |
| 10,371,888 | B1 * | 8/2019 | Chrisman | G02B 6/0093 |
| 11,073,271 | B1 * | 7/2021 | Huang | F21V 29/717 |
| 2005/0207166 | A1 * | 9/2005 | Kan | F21V 29/87 362/373 |
| 2009/0180281 | A1 * | 7/2009 | Ahland, III | F21V 25/10 362/234 |
| 2011/0110077 | A1 | 5/2011 | Klus | |
| 2014/0092596 | A1 * | 4/2014 | Deutsch | F21V 5/08 362/235 |
| 2015/0362155 | A1 | 12/2015 | Thomsen et al. | |
| 2016/0076743 | A1 * | 3/2016 | Deutsch | F21V 13/02 362/268 |
| 2017/0114993 | A1 * | 4/2017 | Kim | F21K 9/20 |
| 2020/0041115 | A1 * | 2/2020 | Kim | F21V 19/003 |

OTHER PUBLICATIONS

French Search Report corresponding French application 2007025 dated Feb. 10, 2021, 2 pages.

* cited by examiner

[Fig 1]
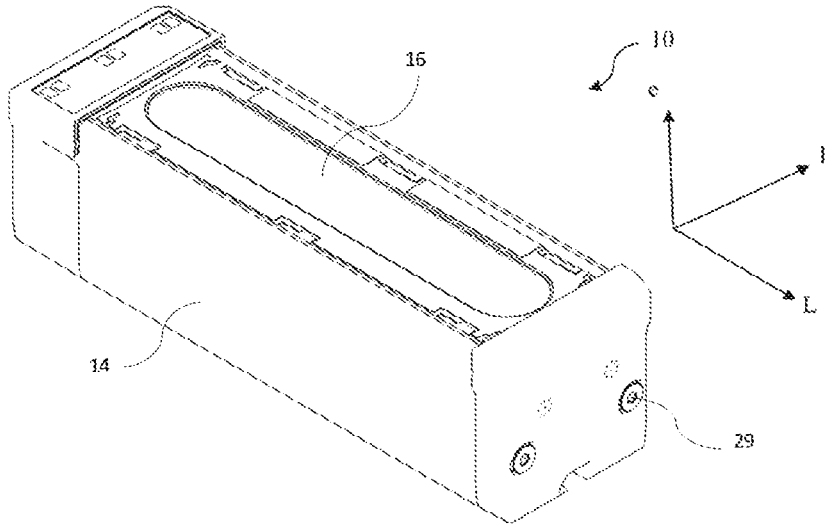
[Fig 2]
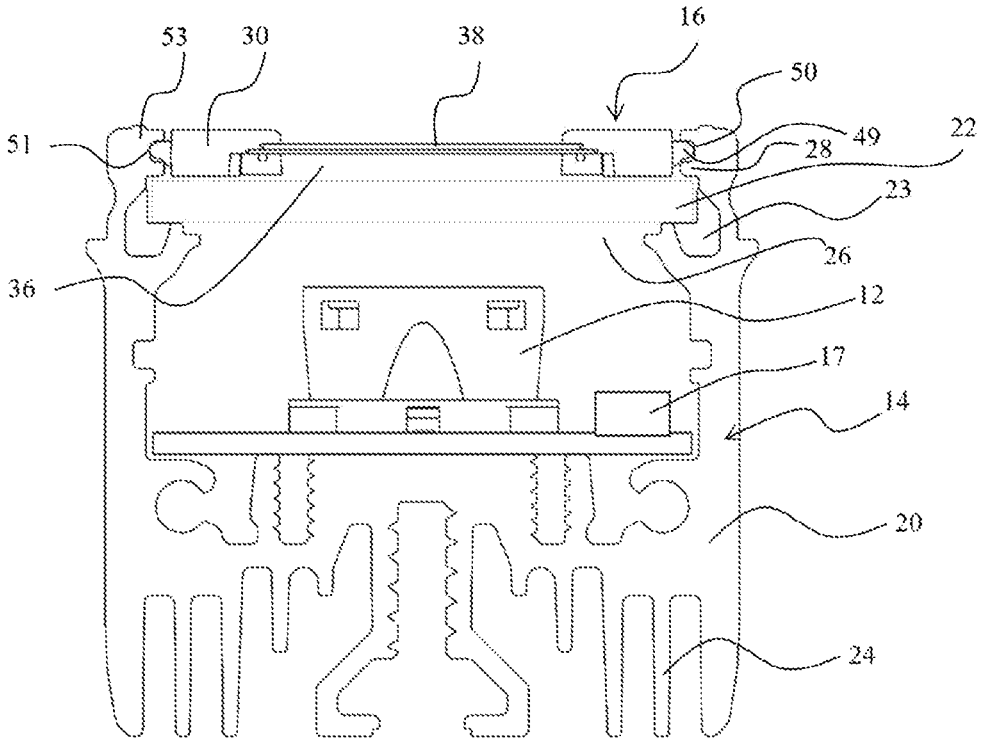

[Fig 3]
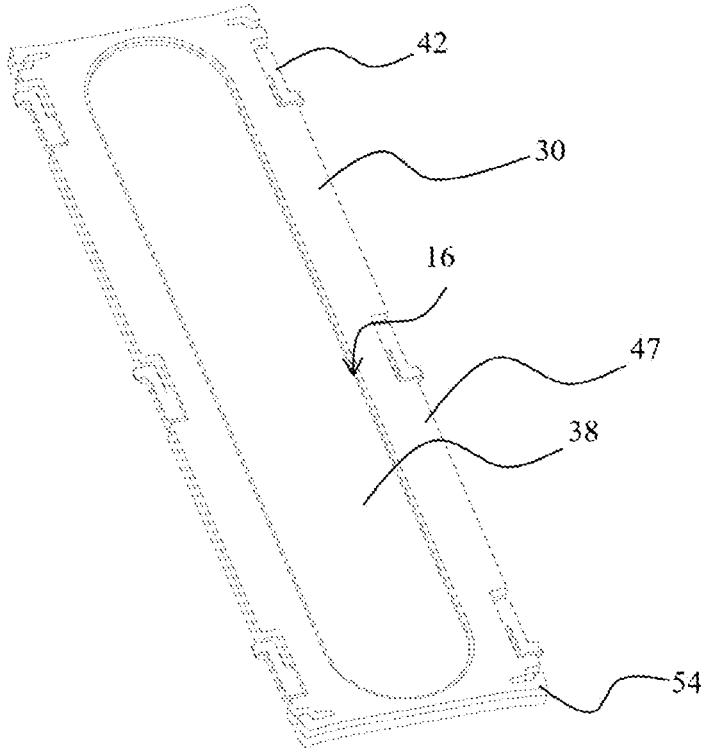
[Fig 4]
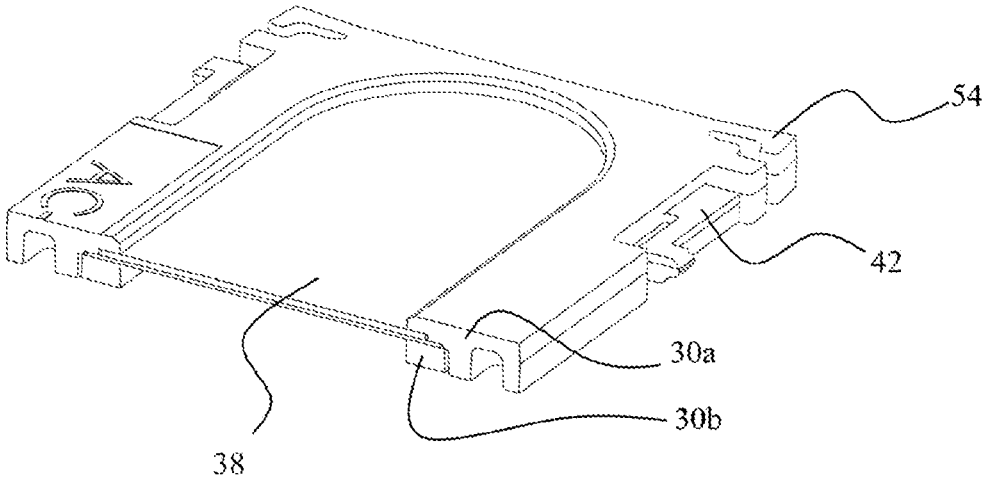

[Fig 5]
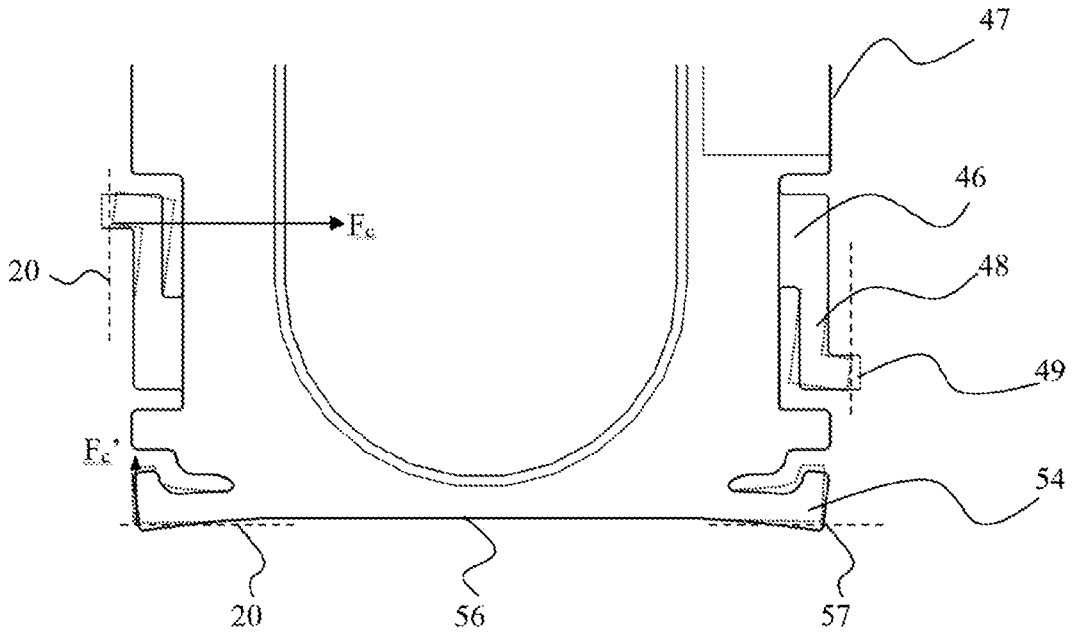
[Fig 6]
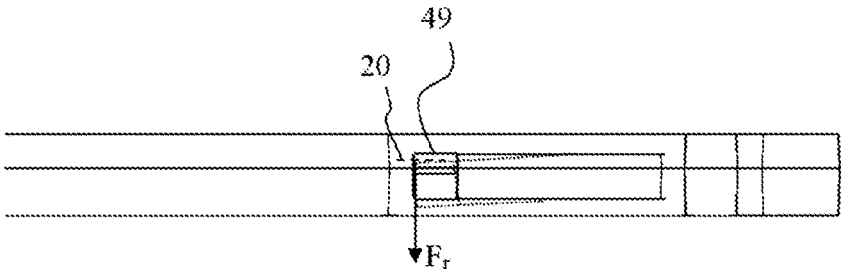

[Fig 7]
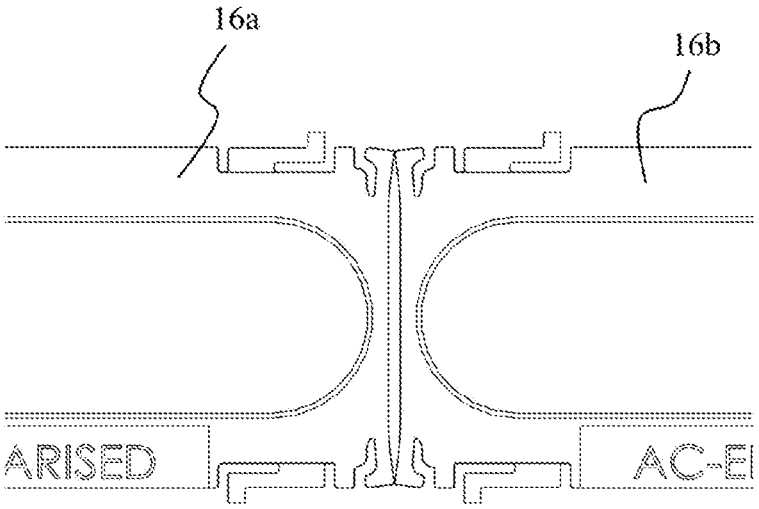
[Fig 8]
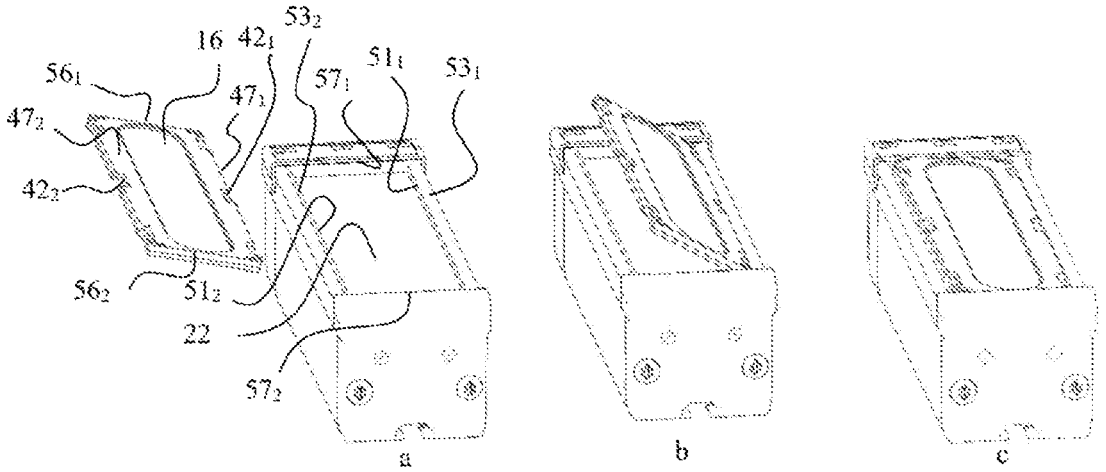

[Fig 9]
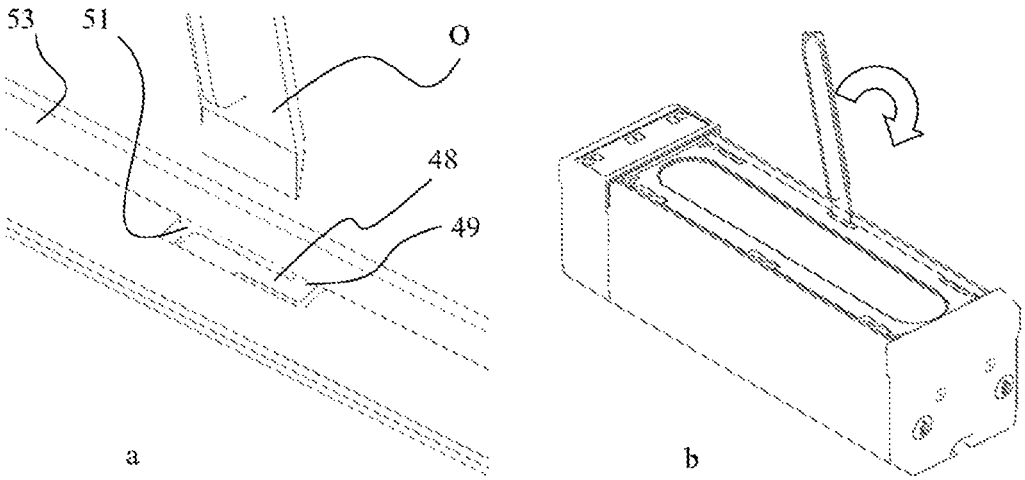

INDUSTRIAL LIGHTING DEVICE

TECHNICAL FIELD

The invention concerns an industrial lighting device.

PRIOR ART

In an industrial environment, lighting devices must resist severe stresses. In particular, they must be sealed for example to class IP 65, and resist vibrations. The vibrations impose accelerations which are typically greater than 10 g, 20 g, 50 g or even greater than 80 g, for example when the device is fixed to an industrial robot. "g" designates the acceleration of the standard gravitational force equal to 9.80665 $m/s^2$.

Also, the lighting conditions impose the need for easy modifiability, in particular in order to adapt to the objects to be illuminated.

There is a permanent need for a new lighting device meeting these constraints, and in particular able to resist extreme external vibrations.

An aim of the invention is to at least partially meet this need.

SUMMARY OF THE INVENTION

The invention proposes an industrial lighting device comprising:

- a light source;
- a sealed housing containing the light source and comprising:
  - a support delimiting a housing window extending opposite the light source, i.e. through which the light source may emit directly towards the exterior of the housing;
  - a window pane sealing the housing window;
  - a sealing gasket extending along the periphery of the housing window and compressed between the window pane and the support,
- a filter extending in front of the housing window, outside the housing and comprising:
  - a frame defining a frame window which is removably fixed to the housing, in an assembled position in which the frame window is opposite the housing window;
  - an optical film fixed to the frame and sealing the frame window, the device comprising an elastic compression member arranged between the support and the frame.

Such an elastic compression member advantageously allows absorption of at least some of the vibrations transmitted to the filter by the support.

A device according to the invention may furthermore comprise one or more of the following optional characteristics:

- the elastic compression member is arranged so as to elastically press an edge of the frame towards the frame window and/or so as to elastically press the frame against the window pane;
- in the plane of the frame, the filter is exclusively in elastic contact with the support;
- the elastic compression member comprises a latch which, in said assembled position, is elastically pressed into a catch defined by the support, preferably into a groove defined by the support, so as to prevent detachment of the filter in a direction perpendicular to the plane of the frame;
- the cooperation of said latch and said catch produces said elastic thrust on the edge of the frame towards the frame window and/or on the frame towards the pane;
- alternatively, the elastic compression member has no latch able to prevent detachment of the filter in a direction perpendicular to the plane of the frame;
- the frame has two opposite straight long edges and two opposite straight short edges, which are preferably perpendicular to the long edges such that the frame has a rectangular form;
- each elastic compression member which comprises a latch, pressed elastically into a catch defined by the support in said assembled position so as to prevent detachment of the filter in a direction perpendicular to the plane of the frame, is arranged on a said long edge, and
- each said elastic compression member which has no latch, able to prevent detachment of the filter in a direction perpendicular to the plane of the frame, is arranged on a said short edge;
- alternatively, each elastic compression member which comprises a latch, pressed elastically into a catch defined by the support in said assembled position so as to prevent detachment of the filter in a direction perpendicular to the plane of the frame, is arranged on a said short edge, and
- each said elastic compression member which has no latch, able to prevent detachment of the filter in a direction perpendicular to the plane of the frame, is arranged on a said long edge;
- at least one, preferably each said elastic compression member is rigidly fixed to or made from the material of the frame;
- the device comprises several said filters arranged side by side so as to cover the entire housing window;
- said filters have the same dimensions;
- said filters have different optical properties;
- the device comprises one said elastic compression member arranged between the facing edges of two frames of two filters arranged side by side.

In a first main embodiment, the device comprises an elastic compression member arranged so as to elastically press a frame edge towards the frame window, known as a "centripetal elastic compression member".

The centripetal elastic compression member allows damping of accelerations in the direction of thrust of the centripetal elastic compression member. It also allows compensation for production tolerances.

Preferably, the device comprises first and second centripetal elastic compression members which exert on the first and second frame edges respectively, preferably the first and second long frame edges, parallel thrust forces in opposite directions.

Preferably, because of the elastic thrust forces on the frame edge, this need not be in abutment on the support, preferably not be in abutment on the housing, in the plane of the frame. In other words, the frame may be displaced parallel to this plane in any direction. The elastic clamping obtained thus gives a particularly high resistance to detachment during application of accelerations in this direction. The filter thus remains attached to the housing even when the industrial lighting device is exposed to severe vibrations.

A centripetal elastic compression member advantageously also allows compensation for production play.

According to a second main embodiment, the device comprises an elastic compression member arranged so as to elastically press the frame towards the pane, also known as an "axial elastic compression member".

The axial elastic compression member allows compensation for production play and the maintaining of a close contact between the frame and the pane in the case of vibrations. This contact advantageously allows the filter to benefit from the damping effect of the sealing gasket.

According to a third main embodiment, the device comprises several filters arranged side by side so as to form a set of filters extending in front of the housing window outside the housing.

A modification in the arrangement of the filters allows a modification of the lighting if the filters are not all identical.

Preferably, the device comprises a centripetal elastic compression member arranged between the edges of the frames of two adjacent filters, preferably each pair of two adjacent filters. Advantageously, the capacity for deformation and vibration absorption in the plane of the frame is thereby substantially increased. The same applies to the capacity for absorption of production play.

The invention furthermore concerns the use of a device according to the invention in an environment in which it is subjected to accelerations greater than 10 g, 20 g, 30 g, 50 g, even 80 g and/or less than 200 g.

The invention finally concerns a kit comprising an industrial lighting device according to the invention and a plurality of supplementary filters.

In one embodiment, supplementary filters have different optical properties from those of the filter or filters of the device. Also, the filter or filters fixed to the housing are outside the housing. Advantageously, they may therefore be disassembled very quickly and replaced with supplementary filters. The lighting provided by the device may thus easily be modified.

Insofar as not incompatible, the characteristics, optional or not, of the various main embodiments may be combined.

Definitions

A "light source" is an electrical source able to emit radiation in the visible, infrared or ultraviolet range.

An "electronic unit" is an assembly comprising electronic components, including a processor and a memory, and software loaded in the memory and comprising program code instructions for execution of desired functions. An electronic unit furthermore comprises input and output ports, in particular for connection of lamps and possibly a camera. It may furthermore preferably comprise a human-machine interface, for example a screen, and preferably a communication module, for example via Internet, Wi-Fi or Bluetooth® or via the telephone network. Finally, it comprises communication busses between the electronic components.

The height direction is the thickness direction.

The thickness direction is perpendicular to a plane parallel to the length and width directions.

The terms "comprise", "contain" and "present" must be interpreted broadly and without limitation unless specified otherwise.

BRIEF DESCRIPTION OF THE FIGURES

Further characteristics and advantages of the invention will appear from reading the detailed description below and from examination of the drawing, in which:

FIG. 1 depicts schematically, in perspective, a lighting device according to the invention;

FIG. 2 depicts schematically a median cross-section through the device from FIG. 1;

FIG. 3 depicts schematically, in perspective, the filter of the lighting device from FIG. 1;

FIG. 4 depicts schematically, in perspective, the filter of the lighting device from FIG. 1 in cross-section;

FIG. 5 depicts schematically, from above, an end of the filter of the lighting device from FIG. 1;

FIG. 6 depicts schematically, from the side, an end of the filter of the lighting device from FIG. 1;

FIG. 7 depicts schematically, from above, a side-by-side set of two filters;

FIG. 8 illustrates the assembly of the filter of the lighting device from FIG. 1;

FIG. 9 illustrates the disassembly of the filter of the lighting device from FIG. 1.

In the various figures, identical references—which may be indexed with different indices—are used to designate identical or similar elements.

The directions of length, width and height (or thickness) are designated L, 1 and e respectively.

DETAILED DESCRIPTION

FIGS. 1 and 2 depict an industrial lighting device 10 according to a preferred embodiment of the invention. This device comprises a light source 12, a housing 14 and a filter 16.

Preferably, the lighting device also comprises an electronic unit 17 configured to control the light source. Preferably, the electronic unit 17 comprises communication means, wired or wireless, allowing reception of instructions issued from outside the housing, for example issued by a camera.

The light source 12 comprises preferably more than two, preferably more than three and/or fewer than ten, fewer than seven, or fewer than five lamps 18. Each lamp 18 may comprise one or more electroluminescent diodes (LED). Each lamp 18 is preferably able to emit at least 200 lumen in a projection cone having an apex angle of 70°. Preferably, the lamps 18 are aligned.

The housing 14 hermetically encloses the light source 12. The protection index (IP) to the international standard of the International Electrotechnical Commission is preferably IP 65, IP 66, IP 67 or IP 68.

The housing 14 comprises a support 20, preferably of aluminum, a window pane 22 and a sealing gasket 23.

The support preferably comprises cooling fins 24 shaped so as to facilitate evacuation of the heat generated by the light source 12.

The support furthermore, conventionally and preferably, comprises a connector 29 through the housing, able to receive energy and/or instructions outside the housing, for example via a cable connected to a power source or to a controller, and to transmit these to the light source and/or the electronic unit.

The housing 14 preferably has the shape of a bar, preferably of rectangular section.

Preferably, it has:

- a length of preferably more than 10 cm, preferably more than 20 cm, and/or less than 300 cm, less than 200 cm, less than 100 cm, less than 60 cm or less than 50 cm, and/or
- a width of more than 4 cm and/or less than 20 cm, 15 cm or 10 cm, and/or a height of more than 4 cm and/or less than 20 cm, 15 cm or 10 cm.

A front face of the housing delimits a housing window 26 which extends opposite the light source 12.

The flat window pane 22 is fixed to the support so as to seal the housing window 26. The pane 22 may be made of any transparent material, for example glass, preferably an optically transparent plastic. The thickness of the pane is preferably more than 0.5 mm and/or less than 8 mm.

The continuous gasket 23 surrounds the window housing 26. A conventional sealing gasket may be used. Preferably, the gasket 23 is a silicone bead.

The peripheral part of the pane 22 is compressed between the gasket 23 and a housing rebate 28. The gasket 23 has an elasticity which allows this compression, and hence the seal, to be maintained in the case of vibrations.

The filter 16 comprises a substantially flat frame 30 defining a frame window 36, and an optical film 38 fixed to the frame 30 and sealing the frame window 36. The filter preferably has a mass of more than 5 grammes or 10 grammes, and/or less than 200 grammes, 100 grammes, 50 grammes, 30 grammes, preferably less than 20 grammes.

The frame 30 is preferably formed from two elementary frames 30*a* and 30*b*, preferably made of plastic and fixed to one another so as to sandwich the optical film 38 between them. Preferably, the two elementary frames are welded together by ultrasound.

Preferably, the width of the frame is substantially identical to that of the housing, preferably more than 90% of the width of the housing.

In one embodiment, the device comprises a single filter. The length and width of the frame 30 are then preferably substantially identical to those of the front face 25 of the housing. Preferably, the surface area of the frame represents more than 90% of the surface area of the front face of the housing.

The length of the frame may however be less than the length of the housing, such that several filters may be arranged along the front face of the housing, as shown on FIG. 7. The filter properties may be identical or different. The choice of filters and their arrangement advantageously allows a high number of possible lighting configurations to be achieved.

Also, a same filter may advantageously be used for housings of different lengths.

The frame 30 preferably has:

- a length of preferably more than 10 cm, preferably more than 20 cm and/or less than 50 cm, less than 40 cm, and/or
- a width of more than 4 cm and/or less than 20 cm, 15 cm or 10 cm, and/or
- a thickness of more than 1 mm and/or less than 10 mm, 5 mm or 3 mm.

The optical film 38 is a film adapted to the desired optical effect. Preferably, the optical film 38 is adapted to modify the shape and/or dimensions of the light beam emitted by the light source.

Preferably, the optical film 38 is a holographic film, for example a holographic film sold by the company Luminit, allowing definition of an apex angle for a projection cone of a lamp.

The optical film 38 is preferably flexible and stretched taut over the frame 30. Preferably, it comprises a thickness of more than 100 microns and/or less than 1 mm, less than 500 microns, preferably less than 400 microns.

The optical film 38 may be fixed to the frame 30 by any means, for example it may be glued or welded or clamped between the two elementary frames.

On its periphery, the frame 30 comprises bolts 42 which are generally L-shaped. As shown on FIG. 5, each bolt comprises:

- a connecting arm 46 forming the short branch of the L, a first end of which is fixed to the peripheral edge of the frame 30, and
- an elastic arm 48 forming the long branch of the L, extending parallel to the peripheral edge of the frame 30 and comprising a first free end and a second end fixed to the second end of the connecting arm 46.

The first free end comprises a protuberance towards the outside, or "latch" 49.

Preferably, the frame 30 comprises bolts 42 only along the edges which extend in the length direction, or "long edges" 47. Preferably, the frame 30 comprises bolts 42 along both its long edges.

The latch 49 of each bolt 42 cooperates with a respective recess, or "catch" 50, defined by the housing for retaining the filter on the housing, i.e. preventing its detachment. More precisely, the shape of the bolt 42 allows elastic deformation of the bolt from its resting shape in order to bring the latch 49 closer to the edge of the frame and allow positioning of the latch 49 opposite the opening of the catch 50. Release of this action on the bolt then allows the latch 49 to be introduced into the catch 50. The latch is then held in the catch in a locked position of the bolt.

The catches of the bolts arranged on a long edge 47 of the frame may in particular be defined by a longitudinal groove 51 defined by the support 20 along the long edge 53 of the support bordering the housing window 36 and adjacent to said long edge 47 of the frame.

Release of the latch from the catch establishes an unlocked position of the bolt necessary for removal of the filter.

At least one bolt, preferably each bolt 42, constitutes a compression member elastically pressing the frame edge on which it is fixed to the frame window. This compression towards the inside of the frame in the plane of the frame is known as "centripetal compression". A centripetal compression may be obtained in particular with a bolt having an elasticity tending to maintain a constant angle between the two arms of the bolt, or "first rest angle". If, in the assembled position of the filter on the housing, the angle between the two arms of the bolt is forced, by the shape of the recess in which it is accommodated, to be smaller than the rest angle, the tendency to resume the first rest angle leads to application of a centripetal force.

On FIG. 5, the bolts are shown in solid lines in their rest position, and in dotted lines in the assembled position of the filter. The contact with the base of the groove of the support 20, shown in dashed lines, produces a centripetal compression force $F_e$.

The centripetal elastic compression advantageously allows absorption of an acceleration in the plane of the filter while holding the bolt in position in its recess.

Preferably, the device comprises one or more pairs of bolts which, in the assembled position of the filter, exert opposing forces, parallel to one another but in opposite directions.

Preferably, the bolts of such a pair are not aligned in the width direction, which allows the bolts to act as poka-yoke devices to ensure that the filter can only be mounted on the housing in one position.

Preferably, the device comprises several bolts arranged so as to ensure full bearing of the frame on the support in a direction parallel to the plane of the frame, or an elastic bearing. In other words, the frame is not in abutment in the plane of the frame. It may be moved elastically in the plane of the frame in any direction, in particular in the length and width directions. The resistance to accelerations in the plane of the filter is thereby substantially increased.

A bolt 42 need not constitute a centripetal elastic compression member, and merely have the function of a bolt for retaining the filter. In particular, in the locking position, the bolt may be in its resting shape, i.e. not exerting any compression on the housing. Under the effect of strong acceleration however, such a bolt may be deactivated, i.e. the latch may come out of the receiving catch.

The device may also comprise one or more centripetal elastic compression members which are separate from the bolts 42 and do not come into axial abutment, i.e. in the height direction, on the housing in order to contribute to the resistance to detachment of the filter. These members are described as "free centripetal elastic compression members". Free centripetal elastic compression members may be provided on all or part of one or more edges of the frame.

On FIGS. 3 and 4, free centripetal elastic compression members are formed by tabs 54 protruding from the short edges 56 of the frame 30. The elasticity of the tabs 54 ensures the centripetal elastic compression of the frame in the length direction. The tabs 52 however do not comprise a latch cooperating with a catch in the housing in order to prevent, by abutment, detachment of the filter.

On FIG. 5, the tabs are shown in solid lines in the rest position and in dotted lines in the assembled position of the filter. The contact with a folded edge 57 of the support 20, shown in dashed lines, produces a centripetal compression force $F_c'$ on the frame.

In one embodiment, the device has bolts 42 forming centripetal elastic compression members only on two opposing frame edges, for example on the two long frame edges. Preferably, on the other edges, for example on the two short frame edges, the device has no bolts 42. On these other edges, it may have no centripetal elastic compression members.

Preferably, on these other edges, it preferably comprises three centripetal elastic compression members. This embodiment, for example as shown on FIGS. 3 to 5, allows easy removal of the filter and provides a high resistance to detachment under the effect of vibrations.

It is also particularly advantageous since it allows alignment of several filters side by side along the housing, two adjacent filters 16*a* and 16*b* being in contact by their short edges as shown on FIG. 7, thus multiplying the vibration-damping members.

The centripetal elastic compression members contribute not only to the vibration resistance, but also to absorbing play resulting from production tolerances. Higher production tolerances, and hence reduced production costs, are thus achievable thanks to the invention.

At least one bolt, preferably each bolt 42, constitutes a compression member elastically pressing the frame towards the pane. This compression towards the pane, perpendicular to the plane of the frame, is described as "axial compression". An axial compression may be obtained in particular with a bolt having an elasticity tending to maintain a constant angle between the elastic arm of the bolt and the plane of the frame, or "second rest angle". If, in the assembled position of the filter on the housing, the angle between the elastic arm of the bolt and the plane of the frame is forced, by the shape of the recess in which the bolt is accommodated, to be smaller than the second rest angle, the tendency to resume the second rest angle leads to application of an axial force on the pane 22.

On FIG. 6, the bolts 42 are shown in solid lines in their rest position and in dotted lines in the assembled position of the filter. The contact with the support 20, shown in dashed lines, produces a radial compression force $F_r$ on the filter.

The axial elastic compression advantageously allows the filter 16 to be held pressed onto the pane 22, irrespective of any displacement of the pane perpendicularly to the plane in which it extends (parallel to the plane of the frame). The pane is elastically supported on the housing via the gasket 23. This elastically deformable gasket helps absorb the effect of an acceleration perpendicular to the frame of the plane. Holding the filter pressed onto the pane advantageously allows the filter to benefit from this absorption. The retention of the bolt in its locked position is thus improved.

Preferably, each bolt 42 constitutes an axial and centripetal elastic compression member. In variants, one or more bolts may constitute exclusively centripetal elastic compression members and/or one or more bolts may constitute exclusively axial elastic compression members.

Function

The function of the lighting device arises directly from the description above.

The mounting of the filter 16 on the housing is illustrated in FIG. 8.

The filter is initially separated from the housing (FIG. 8-*a*).

A first long edge $\mathbf{47}_1$ of the filter frame, carrying first bolts $\mathbf{42}_1$, is pressed by an operator against the first long edge $\mathbf{53}_1$ of the support 20 against first bolts $\mathbf{42}_1$ (FIG. 8-*b*). More precisely, the latches of the first bolts are introduced into a first groove $\mathbf{51}_1$ defined by the first long edge $\mathbf{53}_1$, then sufficiently compressed that the second long edge $\mathbf{47}_2$ of the frame of the filter can be arranged facing a second groove $\mathbf{51}_2$ defined by the second long edge $\mathbf{53}_2$ of the support.

The filter may also be slightly twisted or curved to facilitate its introduction between the first and second folded edges $\mathbf{57}_1$ and $\mathbf{57}_2$ of the support.

The operator then ceases to press the filter against the first long edge $\mathbf{53}_1$ of the support 20. The action of the first bolts $\mathbf{42}_1$ then presses the filter back towards the second long edge $\mathbf{53}_2$ of the support 20, which causes the latches of the second bolts $\mathbf{42}_2$ carried by the second long edge $\mathbf{47}_2$ of the filter frame to engage in the second groove $\mathbf{51}_2$. The filter is then in the assembled position.

In this position, the latches of bolts $\mathbf{42}_1$ and $\mathbf{42}_2$ are engaged in the grooves $\mathbf{51}_1$ and $\mathbf{51}_2$ respectively, which constitute catches preventing the detachment of the filter.

The bolts are also compressed by the contact of the latches with the grooves such that the filter is elastically compressed:

- laterally along the two long edges of the frame, in the plane of the frame, and
- axially, i.e. vertically, perpendicularly to the plane of the frame.

Also, tabs 54 carried by the first and second short edges $\mathbf{56}_1$ and $\mathbf{56}_2$ of the filter frame are elastically supported on the first and second folded edges $\mathbf{57}_1$ and $\mathbf{57}_2$ of the support. The tabs 54 thus also contribute to compressing the filter in the plane of the frame, by exerting a compression force in the length direction.

In the assembled position (FIG. 8-*c*), the filter is thus elastically "suspended" in the plane of the frame, i.e. it may be displaced elastically in this plane, in particular in the length direction or in the width direction. This suspension enables it to effectively absorb vibrations.

Also, the filter is elastically pressed against the pane 22 so as it permanently follows the movements of the pane. It thus benefits from the damping effect of the gasket 23.

Removal of the filter is illustrated in FIG. 9.

To deactivate the bolt 42, the flat end of a tool O is used. This end, similar to that of a flat-bladed screwdriver, is introduced between the long edge 53 of the support and the elastic arm 48 of the bolt (FIG. 9-*a*).

Rotation of the tool as illustrated on FIG. 9-*b* allows compression of the bolt and removal of the latch 49 from the groove 51 defined by the long edge 53 of the support, and hence release of the bolt. The filter may then be locally separated from the housing. Preferably, the three bolts of a same long edge of the frame are deactivated simultaneously, then this long edge is pulled in order to extract the filter.

The filter may then be replaced by another filter with different optical properties.

Kit

The possibility of easy removal of the filter allows its rapid replacement by another filter having different properties, for example in order to modify the projection cone of the lamps.

A kit according to the invention thus comprises, in addition to a lighting device according to the invention, one or more supplementary filters, the optical films of which have different properties from the optical films of one or more filters fixed to the housing.

The description above in relation to the filter 16 is applicable to the supplementary filters.

As will now be evident, the invention provides a simple solution which advantageously allows good support of the filter on the housing while allowing high production tolerances for the housing.

Naturally, the invention is not limited to the embodiments described and depicted, which are provided solely for illustrative purposes.

In particular, the frame need not be flat. The number and position of the bolts and tabs may be different.

The invention claimed is:

1. Industrial lighting device comprising:

a light source;

a sealed housing containing the light source and comprising:

a support delimiting a housing window extending opposite the light source;

a window pane sealing the housing window; and a sealing gasket extending along the periphery of the housing window and compressed between the window pane and the support, a filter extending in front of the housing window, outside the housing and comprising:

a frame defining a frame window which is removably fixed to the housing, in an assembled position in which the frame window is opposite the housing window;

an optical film fixed to the frame and sealing the frame window, the device comprising an elastic compression member arranged between the support and the frame, wherein the elastic compression member is arranged so as to elastically press the frame against the support.

2. Device according to claim 1, wherein the elastic compression member is arranged so as to elastically press an edge of the frame towards the frame window and/or so as to elastically press the frame against the window pane.

3. Device according to claim 1, wherein in the plane of the frame, the filter is exclusively in elastic contact with the support or with an adjacent filter.

4. Device according to claim 1, wherein the elastic compression member comprises a latch (49) which, in said assembled position, is elastically pressed into a catch defined by the support so as to prevent detachment of the filter in a direction perpendicular to the plane of the frame.

5. Device according to claim 1, wherein the elastic compression member has no latch able to prevent detachment of the filter in a direction perpendicular to the plane of the frame.

6. Device according to claim 5, comprising several said elastic compression members wherein the frame has a rectangular form and comprises two opposite straight long edges and two opposite straight short edges perpendicular to the long edges, and wherein each elastic compression member which comprises a latch, pressed elastically into a catch defined by the support in said assembled position so as to prevent detachment of the filter in a direction perpendicular to the plane of the frame, is arranged on a said long edge, and each said elastic compression member which has no latch, able to prevent detachment of the filter in a direction perpendicular to the plane of the frame, is arranged on a said short edge, or wherein each elastic compression member which comprises a latch, pressed elastically into a catch defined by the support in said assembled position so as to prevent detachment of the filter in a direction perpendicular to the plane of the frame, is arranged on a said short edge, and each said elastic compression member which has no latch, able to prevent detachment of the filter in a direction perpendicular to the plane of the frame, is arranged on a said long edge.

7. Device according to claim 1, wherein at least one elastic compression member is rigidly fixed to or made from the material of the frame.

8. Device according to claim 1, comprising several said filters arranged side by side so as to cover the entire housing window.

9. Device according to claim 8, wherein said filters have the same dimensions.

10. Device according to claim 8, wherein said filters have different optical properties.

11. Device according to claim 8, comprising one said elastic compression member arranged between the facing edges of two frames of two filters arranged side by side.

12. Device according to claim 1, wherein the housing has a protection index to the international standard of the International Electrotechnical Commission of IP 65, IP 66, IP 67 or IP 68.

13. Device according to claim 1, wherein the frame is composed of two elementary frames which are thereto-welded to one another so as to sandwich the optical film between them.

14. Use of a device according to claim 1, in an environment in which the device is subjected to accelerations greater than 20 g.

* * * * *